US006969298B2

(12) United States Patent
Deller

(10) Patent No.: US 6,969,298 B2
(45) Date of Patent: Nov. 29, 2005

(54) GRINDING MACHINE, IN PARTICULAR CENTERLESS CYLINDRICAL GRINDING MACHINE

(75) Inventor: Rolf Deller, Selzach (CH)

(73) Assignee: Agathon AG Maschinenfabrik, Solothurn (CH)

( * ) Notice: Subject to any disclaimer, the term of this patent is extended or adjusted under 35 U.S.C. 154(b) by 0 days.

(21) Appl. No.: 10/882,351

(22) Filed: Jul. 2, 2004

(65) Prior Publication Data

US 2005/0003739 A1 Jan. 6, 2005

(30) Foreign Application Priority Data

Jul. 4, 2003 (EP) ..... 03405501

(51) Int. Cl.[7] ..... B24B 51/00
(52) U.S. Cl. ..... 451/5; 451/11; 451/244
(58) Field of Search ..... 451/1, 5, 11, 51, 451/56, 243, 244, 407, 408

(56) References Cited

U.S. PATENT DOCUMENTS

| | | | | |
|---|---|---|---|---|
| 4,538,587 A | | 9/1985 | Nilsson | |
| 4,570,386 A | | 2/1986 | Unno et al. | |
| 5,643,051 A | * | 7/1997 | Zhou et al. | 451/11 |
| 5,766,057 A | * | 6/1998 | Maack | 451/21 |
| 6,312,318 B1 | * | 11/2001 | Mushardt et al. | 451/49 |

FOREIGN PATENT DOCUMENTS

| | | |
|---|---|---|
| DE | 2 153 201 | 5/1972 |
| DE | 2 260 102 | 12/1973 |
| JP | 6-246634 | 9/1994 |

* cited by examiner

*Primary Examiner*—Jacob K. Ackun, Jr.
(74) *Attorney, Agent, or Firm*—Oblon, Spivak, McClelland, Maier & Neustadt, P.C.

(57) ABSTRACT

A grinding machine, in particular a centerless cylindrical grinding machine, comprising: a supporting table, at least one wheel disposed on at least one wheel carriage, a device for holding a workpiece to be machined, the wheel carriage being movable in each case in a controlled way toward the holding device for the workpiece to be machined and away therefrom, and at least one dressing device. For dressing, the respective dressing device and the corresponding wheel are adjusted relative to one another in a controlled way. The dressing device is disposed on a carriage which is movable along a first axis aligned substantially parallel to the rotational axis of the respective wheel. During the moving of the dressing device along the first axis, a stationary guide way determines a reference position of the dressing device with respect to the wheel to be dressed in orthogonal direction to the first axis. In this way inaccuracies in the overall guiding mechanics during the movement of the dressing device can be eliminated, a very precise dressing of the respective wheel being achieved.

13 Claims, 4 Drawing Sheets

GRINDING MACHINE, IN PARTICULAR CENTERLESS CYLINDRICAL GRINDING MACHINE

The present invention relates to a grinding machine, in particular a centerless cylindrical grinding machine, comprising: a supporting table, at least one wheel disposed on at least one wheel carriage, a device for holding a workpiece to be machined, the wheel carriage being movable in each case in a controlled way toward the holding device for the workpiece to be machined and away therefrom, and at least one dressing device for dressing the wheel.

Produced with grinding machines and centerless cylindrical grinding machines are especially parts which must fulfil very high demands with respect to the precision of the dimensions. This means that the dressing operations for the grinding wheel and, if applicable, the regulating wheel of machines of this kind must be carried out very precisely.

Centerless cylindrical grinding machines are known in which the dressing device is disposed on a CNC-controlled compound slide rest. The one axis of this compound slide rest is at a right angle to the rotational axis of the wheel to be dressed, while the other axis of this compound slide rest is aligned parallel to the rotational axis of the wheel to be dressed. By means of this compound slide rest the dressing device is brought into the area of the wheel to be dressed and is set thereon; during the dressing the dressing device is moved along the other axis, which is aligned parallel to the rotational axis of the wheel to be dressed. With configurations of this kind, wheels to be dressed can be given contours, or can be trued.

It has now been demonstrated that with CNC axis controls of this kind guiding mechanics do not have a degree of accuracy corresponding to the required precision of the pieces to be produced. In particular with the method with the dressing device parallel to the rotational axis of the wheel to be dressed, these deficiencies in precision affect the contouring or dimensional accuracy of the workpieces to be produced.

The object of the present invention is thus to design the dressing devices of a grinding machine such that the respective wheels can be dressed with high precision, so that the workpieces to be produced have the required precision.

The object is achieved according to the invention in that, for dressing, the respective dressing device and the corresponding wheel are adjustable relative to one another in a controlled way, the dressing device is disposed on a carriage which is movable along a first axis aligned substantially parallel to the rotational axis of the respective wheel, and wherein during the moving of the dressing device, along the first axis, a stationary guide way determines a reference position of the dressing device with respect to the wheel to be dressed in orthogonal direction to the first axis, starting from which reference position the dressing device and the wheel to be dressed are movable toward one another in a controlled way.

Through the use of a guide way of this kind along which the dressing device is moved the dressing device obtains a reference position with respect to the wheel to be dressed, which is very precise, whereby, if necessary, the too great imprecision of the guiding and driving mechanics of the CNC axis control along the first axis can be eliminated.

The arrangement according to the invention is usable in particular also in centerless cylindrical grinding machines, equipped in each case with a grinding wheel disposed on a grinding wheel carriage and with a regulating wheel disposed on a regulating wheel carriage, the grinding wheel and the regulating wheel being disposed opposite one another and the rotational axes of the grinding wheel and of the regulating wheel being mutually aligned, and the device for holding a workpiece to be machined being designed as a workpiece support device disposed between the two wheels.

Preferably, the carriage on which the respective dressing device is disposed is installed on the respective wheel carriage. A simple construction is thereby obtained, in particular also with the regulating wheel carriage when the latter is put on a swivel plate pivotable about a vertical axis with respect to the supporting table.

Preferably, the dressing device is put on a sliding carriage, which is slidable along guides aligned at a right angle to the first axis. Obtained in this way can be an independence of the dressing device from the guides parallel to the rotational axis of the wheel to be dressed.

Another preferred embodiment of the invention consists in the respective guide way being designed as a gib, and the sliding carriage being provided with a follower element which runs along the gib and is in contact therewith. Resulting from this configuration is a simpler construction of the device.

Preferably, the sliding carriage with the dressing device and thus the follower element is pressable against the gib by elastic means. It is thereby ensured that the follower element is always in contact with the gib.

A further preferred embodiment of the invention consists in the dressing device being put on the carriage that is disposed on the sliding carriage, which is put on the wheel carriage, and the gib being fixed to the substructure of the wheel carriage disposed on the supporting table, and, for dressing the respective wheel, the corresponding wheel carriage is movable and settable with respect to the corresponding dressing device, and the sliding carriage, held through the follower element and the gib, slides along the guides on the wheel carriage. A CNC-controlled axis can thereby be omitted, simplifying the construction of the installation.

The dressing device can also be put on the sliding carriage, which, for its part, is disposed on the carriage, this carriage being put on a supplementary carriage, which is settable on the respective wheel and removable therefrom perpendicular to the rotational axis of the respective wheel along the guides disposed on the wheel carriage and wherein the gib is fixed to the supplementary carriage. In this way, for dressing the respective wheel, the supplementary carriage is movable and the dressing device settable with respect to the respective wheel. The wheel carriage thus does not have to be moved during dressing.

Preferably, the respective carriages, the supplementary carriages and the wheel carriages are movable via CNC axis control.

Embodiments of the invention will be explained more closely in the following, by way of example, with reference to the attached drawing.

Figure 1:
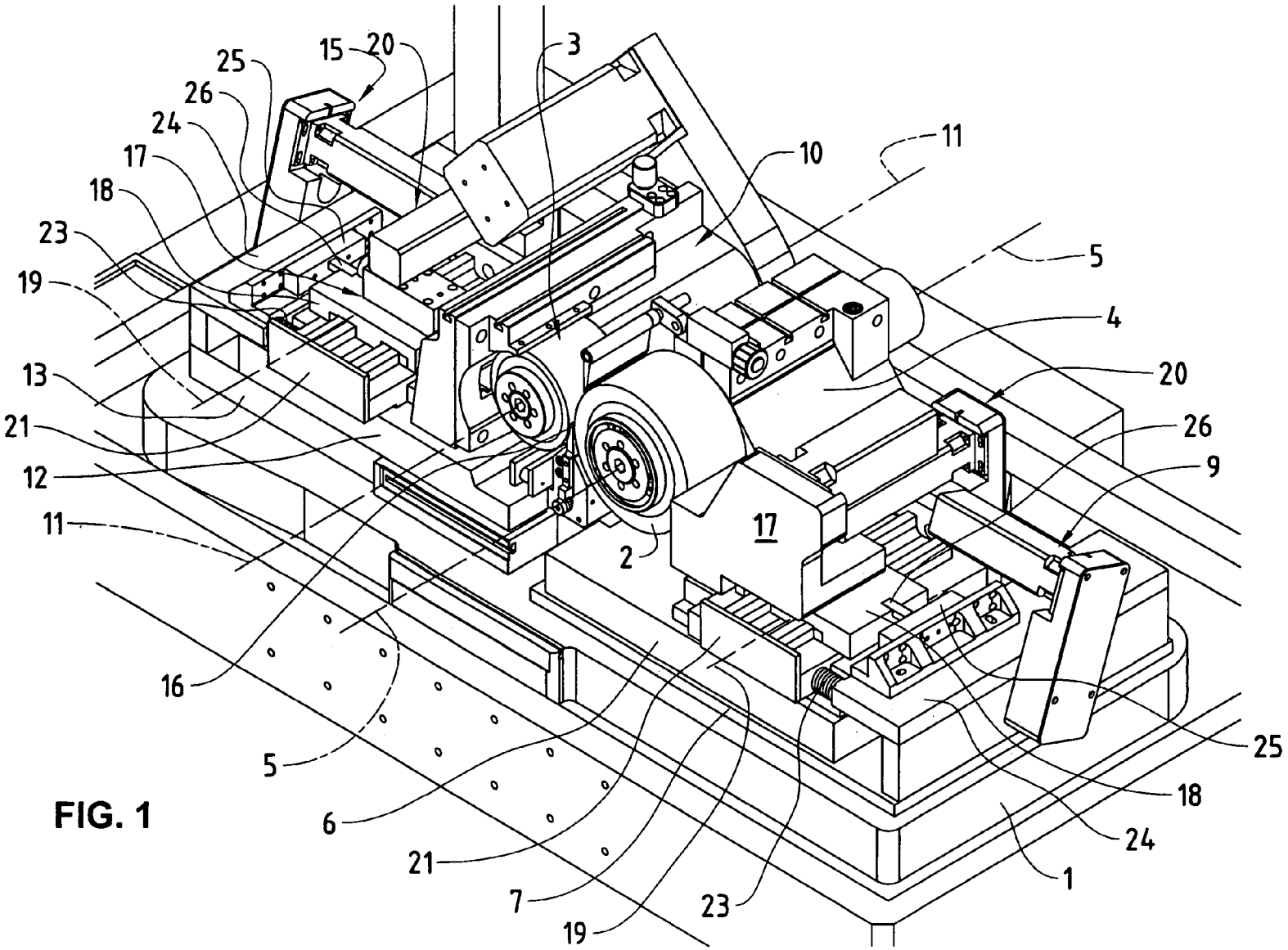
FIG. 1 shows in a spatial representation the supporting table with the respective structure for the grinding wheel and for the regulating wheel according to a first embodiment of the invention.

Seen in FIG. 1 is the supporting table 1 of a centerless cylindrical grinding machine according to a first embodiment, on which disposed on the one side is the grinding wheel 2 and disposed on the other side is the regulating wheel 3. Borne in a headstock 4, the grinding wheel 2 is rotatable about the rotational axis 5. This headstock 4 is fixed on a grinding wheel carriage 6. This grinding wheel carriage 6 is put on a base 7, which is fixed on the supporting table 1. Installed between grinding wheel carriage 6 and base 7 are linear guides 14 (FIG. 2), along which the grinding wheel carriage 6 is displaceably positioned at a right angle to the rotational axis 5 with respect to the supporting table 1. The displacement takes place in a known way via CNC control (not shown), the actuation 9 of which is visible in FIG. 1. Of course it is also conceivable for the grinding wheel carriage 6 to be put directly on the supporting table 1, without base 7.

The regulating wheel 3 is, for its part, borne in a further headstock 10, in a way rotatable about the rotational axis 11. This headstock 10 of the regulating wheel 3 is fixed on the regulating wheel carriage 12. This regulating wheel carriage 12 is put on a swivel plate 13, which is pivotable with respect to the supporting table 1 in a known way about a vertical axis (not shown), in order to be able to set an angular position of the regulating wheel 3 with respect to the grinding wheel 2, if necessary. Installed between this swivel plate 13 and the regulating wheel carriage 12 are likewise linear guides 14 (FIG. 2), along which the regulating wheel carriage 12 is displaceable at a right angle to the rotational axis 11 of the regulating wheel 2. This displacement also takes place in a known way via CNC control, the actuation 15 of which is visible in FIG. 1.

Inserted between the grinding wheel 2 and the regulating wheel 3, which are disposed opposite one another, is a workpiece support device 16. Put on this workpiece support device 16 in a known way are the workpieces to be machined. For grinding, the grinding wheel carriage 6 with the grinding wheel 2 and the regulating wheel carriage 12 with the regulating wheel 3 can be moved toward the workpiece support device 16.

Disposed on the grinding wheel carriage 6 as well as on the regulating wheel carriage 12 is in each case a dressing device 17, which, in principle, is constructed substantially the same way for the dressing of the grinding wheel 2 and the dressing of the regulating wheel 3, which is why the same reference numerals have been used in the following description for components having the same features for both dressing devices 17.

The dressing device 17 is disposed on a carriage 18, which is displaceable along the first axis 19, which is aligned parallel to the respective rotational axis 5, 11. Serving for the displacement is once again a CNC control in a known way, the actuation 20 of which is visible in FIG. 1.

The carriage 18 is put on a sliding carriage 21, which is displaceable along guides 22 (FIG. 2), which are aligned at a right angle to the first axis 19. This sliding carriage 21 is pulled via elastic means 23, which are designed as tension springs, against an attachment 24 firmly connected to the base 7, 13. Fixed to the attachment 24 is a guide way designed as a gib 25. Installed on the carriage 18 is a follower element 26, which is pressed against the gib 25 by the tension springs 23 via the sliding carriage 21 and the carriage 18.

Figure 2:
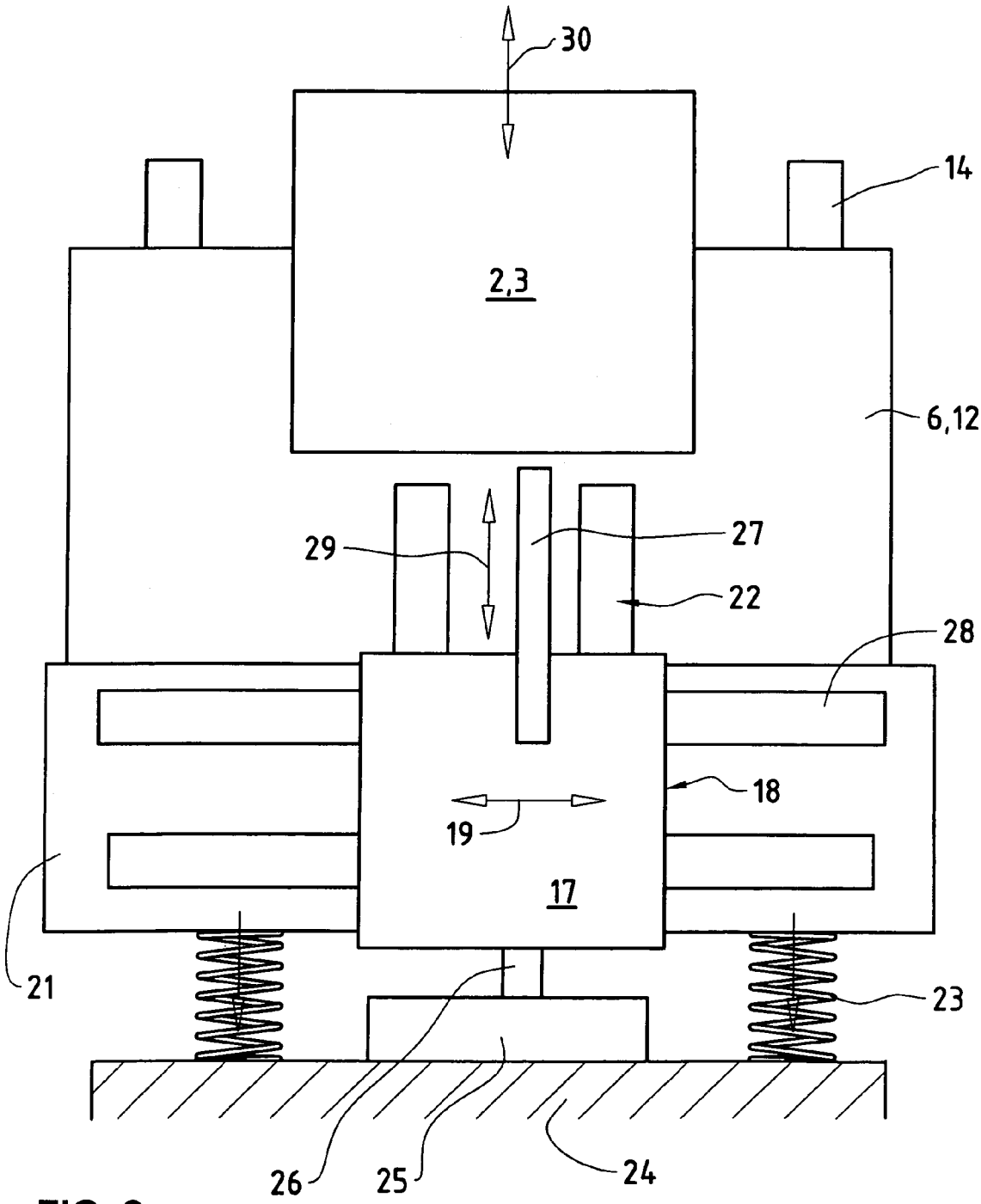
FIG. 2 shows in a diagrammatic representation the arrangement of the dressing device on the respective wheel table with the respective wheel to be dressed according to the embodiment of FIG. 1.

The dressing operation will be described more closely in the following with reference to the diagrammatic representation according to FIG. 2, this dressing operation being applicable to both the dressing of the grinding wheel 2 and to the dressing of the regulating wheel 3. In this FIG. 2 the dressing device 17 can be seen which is provided with a dressing tool 27. This dressing device 17 is disposed on the carriage 18, which is movable along the first axis, represented by the double arrow 19, along the guides 28. The carriage 18 is, for its part, put on the sliding carriage 21. This sliding carriage 21 is freely movable along the guides 22, which are disposed on the wheel carriage 6 or respectively 12, indicated by the double arrow 29. This sliding carriage 21 is pulled by the springs 23 toward the attachment 24, here the follower element 26 supports itself continuously on the gib 25.

To dress the respective wheel 2 or respectively 3, which are disposed on the respective wheel carriage 6 or respectively 12, the wheel carriage 6 or respectively 12 is moved toward the dressing tool 27, in the direction indicated by the double arrow 30. During this movement of the wheel carriage 6, 12, this wheel carriage 6, 12 displaces itself under the sliding carriage 21, which is held by the follower element 26, which is supported on the gib 25. Upon reaching the correct position of the wheel 2, 3 with respect to the dressing tool 27, which is moved in via the CNC control, the dressing operation begins. For this purpose the carriage 18, actuated by the CNC control, is moved along the guides 28. During the movement, the follower element 26 displaces itself correspondingly on the gib 25. Since the sliding carriage 21 is completely free with respect to the direction indicated by the double arrow 29, the position of the dressing tool 27 in this direction is thus determined exdusively by the gib 25, one thereby obtains a very precise reference position. Any possible inaccuracies in the guiding and driving mechanics between the sliding carriage 21 and the carriage 18, which can bring about a movement of the dressing tool 27 during the dressing toward the wheel 2, 3 to be dressed and away therefrom, is completely compensated. One thus obtains a very precise dressing of the respective wheel 2, 3. During the dressing operation, the wheel carriage 6 or respectively 12, controlled by the CNC control, allows itself to be moved in the direction of the double arrow 30, when the wheel 2 or respectively 3 to be dressed is supposed to be trued or respectively provided with a contour. This additional movement takes place with exact reference to the reference position; the desired precision continues to be maintained.

Figure 3:
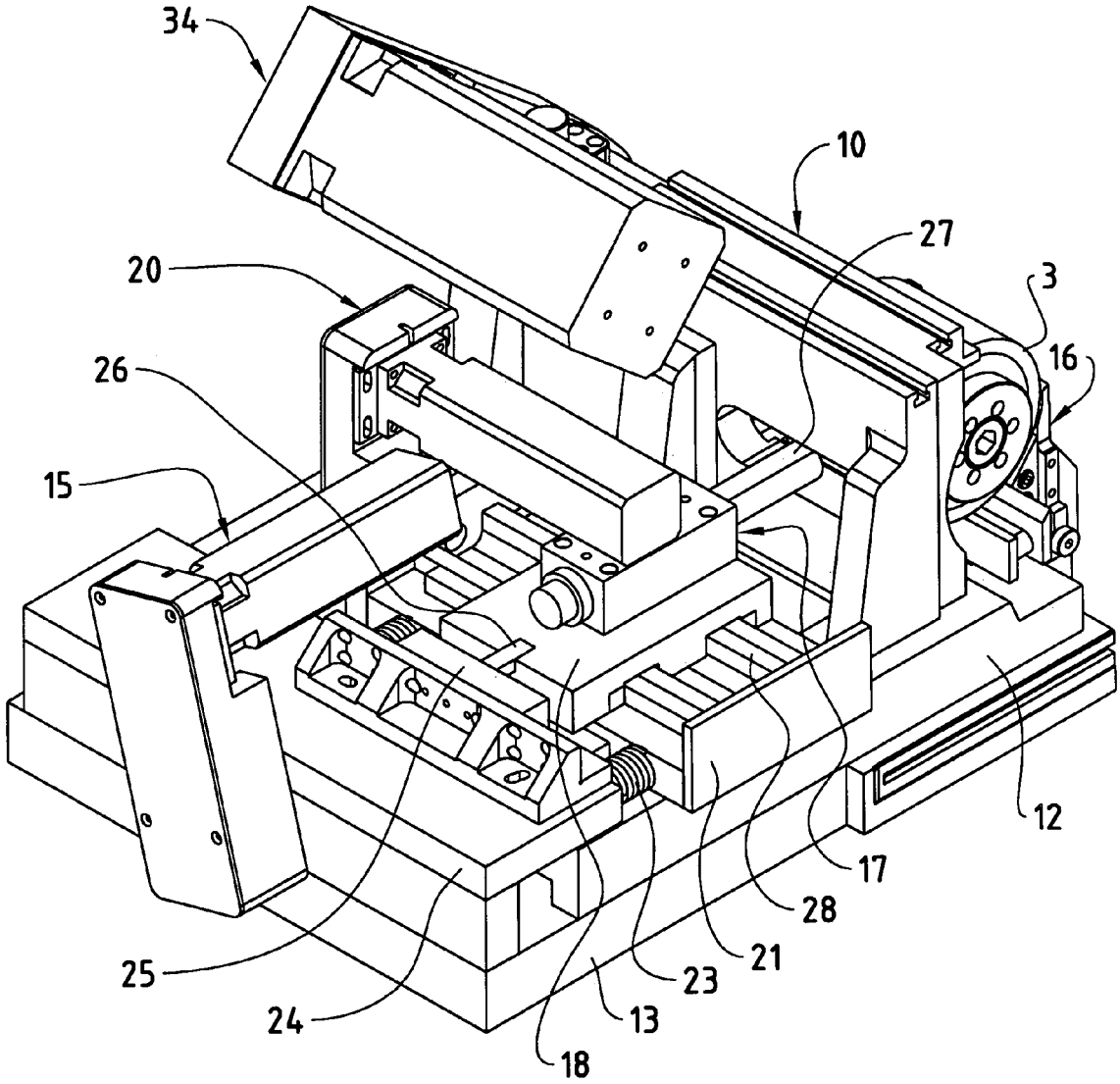
FIG. 3 shows in a spatial representation the structure of the installation on the regulating wheel side, in comparison with FIG. 1, seen from the left.

FIG. 3 shows the structure of the supporting table 1 on the regulating wheel side, according to FIG. 1, seen from the left. Visible here is the headstock 10 of the regulating wheel 3, which is disposed on the regulating wheel carriage 12. Via the drive 34, the regulating wheel 3 is driven in a way exactly controlled with respect to rotational frequency. Likewise visible is the workpiece support device 16, on which the workpiece to be machined is put.

The regulating wheel carriage 12 is disposed on the swivel plate 13 and is displaceable relative thereto at a right angle to the rotational axis 11 of the regulating wheel 3, via the actuation 15.

Disposed on the regulating wheel carriage 12 is the dressing device 17, which is put on the carriage 18, which, for its part, is disposed on the sliding carriage 21. The movement of the carriage 18 along the guides 28 on the sliding carriage 21 takes place via the actuation 20. Installed on the dressing device 17 is the dressing tool 27.

The attachment 24, on which the gib 25 is fixed, is held on the swivel plate 13. Via the springs 23, the sliding carriage 21 and consequently the carriage 18 are pulled with the follower element 26 against the gib 25. The dressing of the regulating wheel 3 takes place according to the method previously described.

Figure 4:
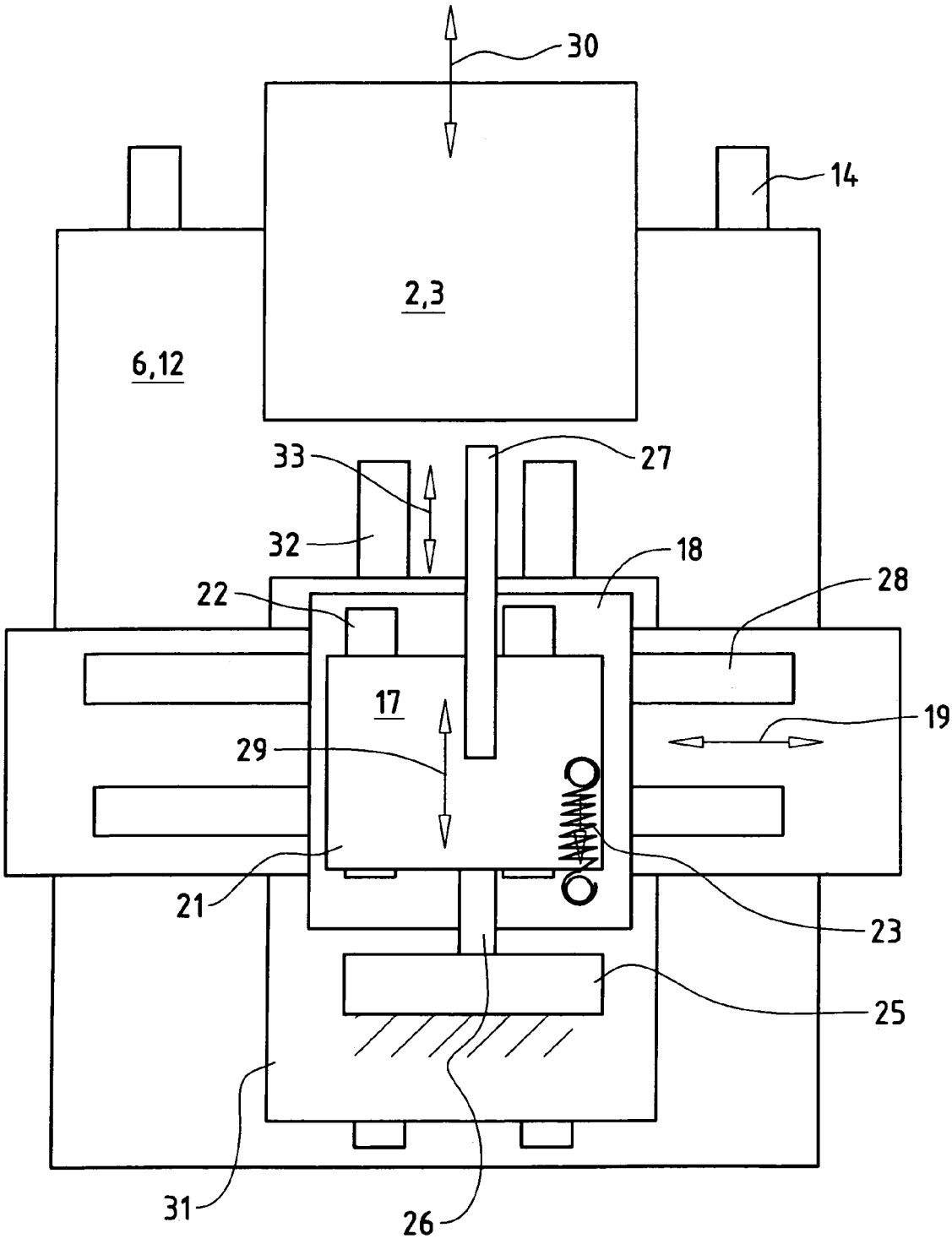
FIG. 4 shows in a diagrammatic representation the arrangement of the dressing device on the respective wheel table with the respective wheel to be dressed according to a further embodiment of the invention.

Shown in FIG. 4 is another embodiment of a dressing configuration, which is likewise constructed the same way for dressing grindings wheel and regulating wheels. For components having the same features as the components of the first embodiment, the same reference numerals have been used.

The dressing device 17 with the dressing tool 27 is disposed on the sliding carriage 21. This sliding carriage 21 is freely displaceable along the guides 22 in the direction of the double arrow 29.

The sliding carriage 21 is put on a carriage 18, on which the guides 28 are installed. This carriage 18 is displaceable along the first axis, shown by the double arrow 19, and thus along the guides 28. Serving for the displacement is once again a CNC control (not shown) in a known way.

These guides 28 are disposed on a supplementary carriage 31, which is put on the wheel carriage 6 or respectively 12. This supplementary carriage 31 is movable in the direction of the double arrow 33, along guides 32 installed on the wheel carriage 6 or respectively 12, parallel to the direction of movement of the wheel carriage 6 or respectively 2, indicated by the double arrow 30. Here, too, a CNC control (not shown) serves for displacement in a known way.

Fixed on the supplementary carriage is the gib 25. Installed on the sliding carriage 21 is the follower element 26. The sliding carriage 21 together with the follower element 26 and thereby the dressing device 17 is pressed against the gib 25 via a tension spring 23.

As with the first embodiment example, a dressing device 17 constructed according to this further embodiment example can be used in a grinding machine on the grinding wheel side as well as on the regulating wheel side.

For dressing the respective wheel 2 or respectively 3, which are disposed on the respective wheel carriage 6 or respectively 12, the supplementary carriage 31 with the dressing device 17 is moved toward the wheel 2 or respectively 3 in a controlled way. Upon reaching the desired position of the dressing tool 27 with respect to the wheel 2 or respectively 3 to be dressed, the carriage 18, driven by the CNC control, is moved in the direction of the first axis 19. During the movement, the follower element 26 displaces itself correspondingly on the gib 25. Since, here too, the sliding carriage 21 is completely free with respect to the direction indicated by the double arrow 29, a very precise reference position is obtained. Here too, during the dressing operation, the supplementary carriage 31, controlled by the CNC control, allows itself to be moved in the direction of the double arrow 33, when the wheel 2 or respectively 3 to be dressed is supposed to be profiled or provided with a contour. This additional movement takes place with exact reference to the reference position; the desired precision continues to be maintained.

With the structure according to this embodiment example it is not necessary, for the dressing, for the respective wheel carriage 6 or respectively 12 to be moved.

With this device according to the invention, the grinding wheel or respectively the regulating wheel can be dressed very precisely since, by means of the reference position of the dressing device, any errors of the guides are able to be completely eliminated during the displacement of the dressing device parallel to the rotational axis of the respective wheel.

What is claimed is:

1. A grinding machine, in particular a centerless cylindrical grinding machine, comprising: a supporting table, at least one wheel disposed on at least one wheel carriage, a device for holding a workpiece to be machined, the wheel carriage being movable in each case in a controlled way toward the holding device for the workpiece to be machined and away therefrom, and at least one dressing device for dressing the wheel, wherein, for dressing, the respective dressing device and the corresponding wheel are adjustable relative to one another in a controlled way, the dressing device is disposed on a carriage which is movable along a first axis aligned substantially parallel to the rotational axis of the respective wheel, wherein during the moving of the dressing device, along the first axis, a stationary guide way determines a reference position of the dressing device with respect to the wheel to be dressed in orthogonal direction to the first axis, starting from which reference position the dressing device and the wheel to be dressed are movable toward one another in a controlled way, and wherein the carriage on which the respective dressing device is disposed is installed on the respective wheel carriage.

2. The grinding machine according to claim 1, wherein it is equipped with a grinding wheel disposed on a grinding wheel carriage and with a regulating wheel disposed on a regulating wheel carriage, the grinding wheel and the regulating wheel being disposed opposite one another and the rotational axes of the grinding wheel and of the regulating wheel being mutually aligned, and the device for holding a workpiece to be machined being designed as a workpiece support device disposed between the two wheels.

3. The grinding machine according to claim 2, wherein the regulating wheel is put on a swivel plate pivotable about a vertical axis with respect to the supporting table.

4. The grinding machine according to claim 1, wherein the dressing device is put on a sliding carriage, which is slidable along guides aligned at a right angle to the first axis.

5. The grinding machine according to claim 4, wherein the respective guide way is designed as a gib, and wherein the sliding carriage is provided with a follower element which runs along the gib and is in contact therewith.

6. The grinding machine according to claim 5, wherein the sliding carriage with the dressing device and thus the follower element is pressable against the gib by elastic means.

7. The grinding machine according to claim 6, wherein the dressing device is put on the carriage that is disposed on the sliding carriage, which is put on the wheel carriage, and wherein the gib is fixed to the substructure of the wheel carriage disposed on the supporting table.

8. The grinding machine according to claim 7, wherein, for dressing the respective wheel, the corresponding wheel carriage is movable and settable with respect to the corresponding dressing device, and the sliding carriage, held through the follower element and the gib, is displaced with respect to the wheel carriage along the guides.

9. The grinding machine according to claim 6, wherein the dressing device is put on the sliding carriage, which, for its part, is disposed on the carriage, this carriage being put on a supplementary carriage, which is settable on the respective wheel and removable therefrom perpendicular to the rotational axis of the respective wheel along the guides disposed on the wheel carriage and wherein the gib is fixed to the supplementary carriage.

10. Grinding machine according to claim 9, wherein, for dressing the respective wheel, the supplementary carriage is movable and the dressing device is settable against the respective wheel.

11. Grinding machine according to one of the claims 1 to 10, wherein the respective carriages, the supplementary carriages and the wheel carriages are movable via CNC axis control.

12. A grinding machine comprising:

a supporting table;

a workpiece holder provided on the supporting table;

a wheel disposed on a wheel carriage provided on the supporting table and configured to be movable toward and away from the workpiece holder; and a dressing device configured to dress the wheel, the dressing device being disposed on a carriage which is movable along a first axis aligned substantially parallel to a rotational axis of the wheel, wherein a stationary guide way is configured to provide a reference position of the dressing device with respect to the wheel in a direction orthogonal to the first axis during dressing of the wheel, and wherein the carriage on which the dressing device is disposed is installed on the wheel carriage.

13. The grinding machine according to claim 12, wherein the carriage on which the dressing device is disposed is slidable along guides aligned at a right angle to the first axis.

* * * * *